US011242612B2

(12) United States Patent
Jing et al.

(10) Patent No.: US 11,242,612 B2
(45) Date of Patent: Feb. 8, 2022

(54) COMPOSITE ELECTROPLATING METHOD FOR SINTERED ND—FE-B MAGNET

(71) Applicants: NINGBO YUNSHENG CO., LTD., Zhejiang (CN); NINGBO YUNSHENG MAGNET DEVICES TECHNOLOGY CO., LTD., Zhejiang (CN)

(72) Inventors: Jingjing Jing, Zhejiang (CN); Caicai Peng, Zhejiang (CN)

(73) Assignees: NINGBO YUNSHENG CO., LTD., Zhejiang (CN); NINGBO YUNSHENG MAGNET DEVICES TECHNOLOGY CO., LTD., Zhejiang (CN)

( * ) Notice: Subject to any disclaimer, the term of this patent is extended or adjusted under 35 U.S.C. 154(b) by 0 days.

(21) Appl. No.: 16/955,782

(22) PCT Filed: Oct. 15, 2018

(86) PCT No.: PCT/CN2018/000354
§ 371 (c)(1),
(2) Date: Jun. 19, 2020

(87) PCT Pub. No.: WO2019/119528
PCT Pub. Date: Jun. 27, 2019

(65) Prior Publication Data

US 2020/0340133 A1 Oct. 29, 2020

(30) Foreign Application Priority Data

Dec. 20, 2017 (CN) ..... 201711381546.6

(51) Int. Cl.

| | |
|---|---|
| ***C25D 5/14*** | (2006.01) |
| ***C25D 7/00*** | (2006.01) |
| ***C25D 3/12*** | (2006.01) |
| ***C25D 3/22*** | (2006.01) |
| ***C25D 3/38*** | (2006.01) |
| ***C25D 3/56*** | (2006.01) |
| ***C25D 5/12*** | (2006.01) |
| ***C25D 5/34*** | (2006.01) |
| ***C25D 5/00*** | (2006.01) |

(52) U.S. Cl.
CPC ..... *C25D 5/14* (2013.01); *C25D 3/12* (2013.01); *C25D 3/22* (2013.01); *C25D 3/38* (2013.01); *C25D 3/562* (2013.01); *C25D 5/12* (2013.01); *C25D 5/34* (2013.01); *C25D 5/605* (2020.08); *C25D 7/001* (2013.01)

(58) Field of Classification Search
None
See application file for complete search history.

(56) References Cited

U.S. PATENT DOCUMENTS

| | | | | |
|---|---|---|---|---|
| 4,917,778 | A | 4/1990 | Takada et al. | |
| 2004/0188267 | A1 * | 9/2004 | Sakamoto | C25D 7/001 205/181 |
| 2005/0056542 | A1 * | 3/2005 | Mitsui | H01F 41/026 205/210 |

FOREIGN PATENT DOCUMENTS

| | | | |
|---|---|---|---|
| CN | 101724845 | 6/2010 | |
| CN | 104480506 | 4/2015 | |
| CN | 106835209 | 6/2017 | |
| CN | 106968003 | 7/2017 | |
| CN | 108251872 | 7/2018 | |
| EP | 0190465 A2 * | 8/1986 | C25D 5/34 |

OTHER PUBLICATIONS

Chen et al. (CN 106968003 A, machine translation). (Year: 2017).*

* cited by examiner

*Primary Examiner* — Wojciech Haske
(74) *Attorney, Agent, or Firm* — JCIPRNET

(57) ABSTRACT

Disclosed is a composite electroplating method for sintered NdFeB magnet, including: a process of pre-treating sintered NdFeB magnet, a process of electroplating the pre-treated sintered NdFeB magnet, and a process of cleaning and drying the electroplated sintered NdFeB magnet. The electroplating process forms a composite coating composed of a Zn coating, a Zn—Ni alloy coating, a Cu coating and a Ni coating on the surface of the sintered NdFeB magnet.

7 Claims, No Drawings

COMPOSITE ELECTROPLATING METHOD FOR SINTERED ND—FE-B MAGNET

CROSS-REFERENCE TO RELATED APPLICATION

This application is a 371 application of the International PCT application serial no. PCT/CN2018/000354, filed on Oct. 15, 2018, which claims the priority benefit of China Patent Application No. 201711381546.6, filed on Dec. 20, 2017. The entirety of each of the above-mentioned patent applications is hereby incorporated by reference herein and made a part of this specification.

TECHNICAL FIELD

The invention relates to an electroplating method, and in particular to a composite electroplating method for sintered Nd—Fe—B magnet.

BACKGROUND

NdFeB permanent magnet material is powder metallurgy material and is composed of multiple phases. The potential difference between the phases is large, and especially the potential of the Nd-rich phase is low, which is likely to case intergranular corrosion. Sintered NdFeB permanent magnets made from the NdFeB permanent magnet material also has poor corrosion resistance. At present, in order to improve the corrosion resistance of sintered NdFeB magnet, a surface anti-corrosion treatment is usually used to form a protective layer on the surface of the sintered NdFeB magnet. Electroplating is a surface anti-corrosion treatment method for sintered NdFeB magnets that are commonly used at present, and mainly includes electro-galvanizing and Ni—Cu—Ni electroplating according to the different electroplating solutions. With the popularization of automatic assembly of end products and the long-life design of products, the requirements for coating hardness, abrasion resistance, scratch resistance, coating adhesion, temperature resistance, and surface cleanliness requirements of magnet products are becoming more and more demanding. Although the electro-galvanizing process can form a coating with high adhesion on the surface of the sintered NdFeB magnet, the single-coating surface formed by electro-galvanizing is easily scratched and has poor corrosion resistance. Although Ni—Cu—Ni electroplating can form a composite coating with high corrosion resistance on the surface of the sintered NdFeB magnet, in the process of Ni—Cu—Ni electroplating, chloride ions in the electroplating corrode the sintered NdFeB magnet severely, causing the surface of the sintered NdFeB magnet to be oxidized and corroded, and eventually leading to poor coating adhesion. In addition, the problem that the electro-galvanized surface with high scratch resistance and the problem of poor coating adhesion in Ni—Cu—Ni electroplating further cause the limited cleaning process after electroplating, resulting in that the surface cleanliness of the final coating is not high.

SUMMARY OF THE INVENTION

The technical problem to be solved by the invention is to provide a composite electroplating method for sintered NdFeB magnet which has high coating adhesion and cleanliness, high scratch resistance and high corrosion resistance.

The technical solution adopted by the invention for solving the above technical problems is a composite electroplating method for sintered NdFeB magnet, including: ① a process of pre-treating sintered NdFeB magnet, ② a process of electroplating the pre-treated sintered NdFeB magnet, and ③ a process of cleaning and drying the electroplated sintered NdFeB magnet; the process of electroplating the pre-treated sintered NdFeB magnet specifically includes the following steps:

②-1 electro-galvanizing the pre-treated sintered NdFeB magnet to form a Zn coating on the surface of the sintered NdFeB magnet;

②-2 performing first activation treatment on the electro-galvanized sintered NdFeB magnet;

②-3 performing Zn—Ni alloy electroplating treatment on the sintered NdFeB magnet after the first activation treatment to form a Zn—Ni alloy coating on the surface of the Zn coating;

②-4 performing second activation treatment on the sintered NdFeB magnet after the Zn—Ni alloy electroplating treatment;

②-5 performing Cu electroplating treatment on the sintered NdFeB magnet after the second activation treatment to form a Cu coating on the surface of the Zn—Ni alloy coating; and ②-6 performing Ni electroplating treatment on the sintered NdFeB magnet after the Cu electroplating treatment to form a Ni coating on the surface of the Cu coating.

The electro-galvanizing process in the step ②-1 uses a zinc sulfate solution as an electroplating solution. The zinc sulfate solution has a PH of 4-5 and a temperature of 20-40° C., and the zinc sulfate solution is formed by uniformly mixing zinc sulfate heptahydrate, boric acid, a brightener and water. Every liter of the zinc sulfate solution includes 380 g-400 g of zinc sulfate heptahydrate, 20 g-40 g of boric acid, and 0.1-0.2 ml of the brightener. The electro-galvanizing treatment is carried out for 1-2 h, and the thickness of the zinc coating is 2-4 μm. According to the method, in the zinc sulfate solution composed of zinc sulfate heptahydrate, boric acid, a brightener, and water, sulfate ion is less corrosive to the NdFeB magnet, and the Zn coating formed by the zinc sulfate solution is rougher. As a result, the coating adhesion can be improved, and the adhesion between the coating and the NdFeB magnet is greater than 20 MPa.

The specific process of the first activation treatment in step ②-2 is as follows: the electro-galvanized sintered NdFeB magnet is activated with a first activating solution for 5-15 s, and the first activating solution is formed by uniformly mixing $HNO_3$, HCl and water. In the first activating solution, the content of $HNO_3$ is 5 ml/L and the content of HCl is 5 ml/L. The method uses the first activating solution composed of $HNO_3$, HCl and water for activation treatment, which can improve the brightness, cleanliness and flatness of the Zn coating, and is beneficial to improving the adhesion between the subsequent coating and the Zn coating.

The Zn—Ni alloy electroplating treatment process in step ②-3 uses a Zn—Ni alloy solution as an electroplating solution. The Zn—Ni alloy solution has a temperature of 30-35° C. and a PH of 5-5.5, and the Zn—Ni alloy solution is formed by uniformly mixing potassium chloride, zinc chloride, nickel chloride and water. Every liter of the Zn—Ni alloy solution includes 150-200 g of potassium chloride, 40-70 g of zinc chloride, and 80-120 g of nickel chloride. The Zn—Ni alloy electroplating treatment is carried out for 1-2.5 h, and the thickness of the Zn—Ni alloy coating is 1.5-4 μm. The Zn—Ni alloy coating is used as a buffer layer to avoid the problem that the adhesion between coatings is worsened due to a loose layer formed by the substitution reaction between Zn and Cu in the sulfate Zn coating. The Zn—Ni alloy has a Zn—Ni ratio different from that of a conventional Zn—Ni alloy which is generally 12%-15%. The Zn—Ni ratio of Zn—Ni alloy in this process is controlled at 16%-20%. By increasing the Ni content in the Zn—Ni alloy coating, the substitution reaction between Zn in the Zn—Ni alloy coating and Cu used in the Cu electroplating process be can effectively suppressed.

The specific process of the second activation treatment in step ②-4 is as follows: the Zn—Ni alloy coating is activated with a second activating solution for 10-20 s, and the second activating solution is formed by uniformly mixing citric acid and water. The content of citric acid in the second activating solution is 0.2-0.5 g/L. The method can improve the surface brightness and cleanliness of the Zn—Ni alloy coating, can effectively provide the adhesion between the coatings, thus preventing the coatings from peeling off.

The Cu electroplating treatment process in step ②-5 uses a Cu solution as an electroplating solution. The Cu solution has a temperature of 45° C. and a PH of 9-12, and the Cu solution is formed by uniformly mixing copper pyrophosphate, potassium pyrophosphate, and water. Every liter of the Cu solution includes 30-70 g of copper pyrophosphate and 240-400 g of potassium pyrophosphate. The Cu electroplating treatment is carried out for 2-4 h, and the thickness of the Cu coating is 3-5 μm. In the method, the Cu electroplating process can increase the compactness of the coating. As the Ni content in the Zn—Ni alloy coating is increased, the brittleness of the coating is enhanced. The Cu coating added to the Zn—Ni alloy coating can help improve the brittleness of the overall coating and prevent the coating at corners from peeling off, so the method can improve the corrosion resistance of the whole coating and improve the brittleness of the coating.

The Ni electroplating treatment process in step ②-6 uses a Ni solution as an electroplating solution. The Ni solution has a temperature of 45° C. and a PH of 4, and the Ni solution is formed by uniformly mixing nickel sulfate, nickel chloride, and water. Every liter of the Ni solution includes 250-350 g of nickel sulfate and 30-70 g of nickel chloride. The Ni electroplating treatment is carried out for 2-4 h, and the thickness of the Ni coating is 3-7 μm. Considering that the surface of the product is to be subjected to laser engraving and automatic assembly, the occurrence of scratches needs to be avoided during the assembly process, and moreover, there are high requirements for acid resistance and high temperature resistance, so the Ni coating is used as a surface coating. The requirements for the abrasion resistance and the corrosion resistance of the above product can be met.

The pretreatment process for the sintered NdFeB magnet in the step ED includes the following steps:

①-1 vibromilling and chamfering the sintered NdFeB magnet;

①-2 dipping and degreasing the vibromilled and chamfered sintered NdFeB magnet for 2-10 min in the presence of a dipping and degreasing solution which has a PH of 9-13 and a temperature of 50-65° C.;

①-3 pickling the dipped and degreased sintered NdFeB magnet for 15-300 s by using a nitric acid solution with a volume concentration of 2-5%;

①-4 ultrasonically cleaning the pickled sintered NdFeB magnet to remove magnetic powder attached to the surface of the product after pickling, wherein an ultrasonic cleaning solution is formed by uniformly mixing sodium citrate and water, and the mass percentage concentration of sodium citrate in the ultrasonic cleaning solution is 5%; and ①-5 rinsing the ultrasonically cleaned sintered NdFeB magnet for three times with overflow water. The remaining acid liquid and magnetic powder on the surface of the magnet can be further cleaned, the surface cleanliness of the NdFeB magnet can be improved, and the adherence between the zinc sulfate coating and the NdFeB magnet can be effectively improved.

Compared with the prior art, the invention has the advantage that the electroplating process is improved as follows: first, the zinc sulfate electroplating process is performed on the sintered NdFeB magnet after the pretreatment to form a Zn coating on the surface of the sintered NdFeB magnet; the first activation treatment is performed on the sintered NdFeB magnet after electro-galvanizing treatment, and then the sintered NdFeB magnet after the first activation treatment is electroplated with a Zn—Ni alloy to form a Zn—Ni alloy coating on the surface of the Zn coating; a second activation treatment is performed on the sintered NdFeB magnet after Zn—Ni alloy electroplating treatment, and then a Cu electroplating treatment treatment is performed on the sintered NdFeB magnet after the second activation treatment to form a Cu coating on the surface of the Zn—Ni alloy coating; finally, the sintered NdFeB magnet after Cu electroplating treatment is electroplated with Ni to form a Ni coating on the surface of the Cu coating; thus a composite coating composed of the Zn coating, the Zn—Ni alloy, the Cu coating and Ni coating is formed on the surface of the sintered NdFeB magnet. The Zn coating in direct contact with the surface of the sintered NdFeB magnet uses a zinc sulfate solution as an electroplating solution, and the Zn—Ni alloy functions as a buffer layer to isolate the Cu coating from the Zn coating, thus ensuring the good adherence among the Zn coating, the Zn—Ni alloy, the Cu coating and the Ni coating on the basis of good adherence of the Zn coating; moreover, the combination of the Cu coating and the Ni coating ensures that the composite coating has excellent corrosion resistance and abrasion resistance. The coating of the sintered NdFeB magnet treated by the method of the invention has high adherence and corrosion resistance, and is barely scratched. The laser engraving on the surface of the coating does not affect the corrosion resistance, and the coating can meet the requirement for 200° C. thermal shock. Experiments have confirmed that the sintered NdFeB magnet treated by the method of the invention has the advantages that the adherence between the composite coating and the sintered NdFeB magnet is greater than 20 MPa, the composite coating has excellent corrosion resistance against 65° C. and $9\times10^{-4}$ mol/L ethanol vapor for 500 h and can resist a high temperature of 200° C.

DETAILED DESCRIPTION

With reference to the embodiments, the invention will be described in more details below.

Embodiment 1: A composite electroplating method for a sintered NdFeB magnet, including: ① a process of pretreating sintered NdFeB magnet, ② a process of electroplating the pre-treated sintered NdFeB magnet, and ③ a process of cleaning and drying the electroplated sintered NdFeB magnet; the process of electroplating the pre-treated sintered NdFeB magnet specifically includes the following steps:

②-1 electro-galvanizing the pre-treated sintered NdFeB magnet to form a Zn coating on the surface of the sintered NdFeB magnet;

②-2 performing first activation treatment on the electro-galvanized sintered NdFeB magnet;

②-3 performing Zn—Ni alloy electroplating treatment on the sintered NdFeB magnet after the first activation treatment to form Zn—Ni alloy coating on the surface of the Zn coating;

②-4 performing second activation treatment on the sintered NdFeB magnet after the Zn—Ni alloy electroplating treatment;

②-5 performing Cu electroplating treatment on the sintered NdFeB magnet after the second activation treatment to form Cu coating on the surface of the Zn—Ni alloy coating;

②-6 performing Ni electroplating treatment on the sintered NdFeB magnet after the Cu electroplating treatment to form a Ni coating on the surface of the Cu coating.

Embodiment 2: A composite electroplating method for sintered NdFeB magnet, including ① a process of pretreating sintered NdFeB magnet, ② a process of electroplating the pre-treated sintered NdFeB magnet, and ③ a process of cleaning and drying the electroplated sintered NdFeB magnet; the process of electroplating the pre-treated sintered NdFeB magnet specifically includes the following steps:

②-1 electro-galvanizing the pre-treated sintered NdFeB magnet to form a Zn coating on the surface of the sintered NdFeB magnet;

②-2 performing first activation treatment on the electro-galvanized sintered NdFeB magnet;

②-3 performing Zn—Ni alloy electroplating treatment on the sintered NdFeB magnet after the first activation treatment to form a Zn—Ni alloy coating on the surface of the Zn coating;

②-4 performing second activation treatment on the sintered NdFeB magnet after the Zn—Ni alloy electroplating treatment;

②-5 performing Cu electroplating treatment on the sintered NdFeB magnet after the second activation treatment to form a Cu coating on the surface of the Zn—Ni alloy; ②-6 performing Ni electroplating treatment on the sintered NdFeB magnet after the Cu electroplating treatment to form a Ni coating on the surface of the Cu coating.

In this embodiment, the electro-galvanizing process in the step ②-1 uses a zinc sulfate solution as an electroplating solution. The zinc sulfate solution has a PH of 4-5 and a temperature of 40° C., and the zinc sulfate solution is formed by uniformly mixing zinc sulfate heptahydrate, boric acid, a brightener and water. Every liter of the zinc sulfate solution includes 400 g of zinc sulfate heptahydrate, 40 g of boric acid, and 0.2 ml of the brightener. The electro-galvanizing treatment is carried out for 2 h, and the thickness of the zinc coating is 4 μm.

In this embodiment, the specific process of the first activation treatment in step ②-2 is as follows: the electro-galvanized sintered NdFeB magnet is activated with a first activating solution for 15 s, and the first activating solution is formed by uniformly mixing $HNO_3$, HCl and water. In the first activating solution, the content of $HNO_3$ is 5 ml/L and the content of HCl is 5 ml/L.

In this embodiment, the Zn—Ni alloy electroplating treatment process in step ②-3 uses a Zn—Ni Ni alloy solution as an electroplating solution. The Zn—Ni alloy solution has a temperature of 35° C. and a PH of 5.5, and the Zn—Ni alloy solution is formed by uniformly mixing potassium chloride, zinc chloride, nickel chloride and water. Every liter of the Zn—Ni alloy solution includes 200 g of potassium chloride, 70 g of zinc chloride, and 120 g of nickel chloride. The Zn—Ni alloy electroplating treatment is carried out for 2.5 h, and the thickness of the Zn—Ni alloy coating is 4 μm.

In this embodiment, the specific process of the second activation treatment in step ②-4 is as follows: the sintered NdFeB magnet after the Zn—Ni alloy electroplating treatment is activated with a second activating solution for 20 s, and the second activating solution is formed by uniformly mixing citric acid and water. The content of citric acid in the second activating solution is 0.5 g/L.

In this embodiment, the Cu electroplating treatment process in step ②-5 uses a Cu solution as an electroplating solution. The Cu solution has a temperature of 45° C. and a PH of 12, and the Cu solution is formed by uniformly mixing copper pyrophosphate, potassium pyrophosphate, and water. Every liter of the Cu solution includes 70 g of copper pyrophosphate and 400 g of potassium pyrophosphate. The Cu electroplating treatment is carried out for 4 h, and the thickness of the Cu coating is 5 μm.

In this embodiment, the Ni electroplating treatment process in step ②-6 uses a Ni solution as an electroplating solution. The Ni solution has a temperature of 45° C. and a PH of 4, and the Ni solution is formed by uniformly mixing nickel sulfate, nickel chloride, and water. Every liter of the Ni solution includes 350 g of nickel sulfate and 70 g of nickel chloride. The Ni electroplating treatment is carried out for 4 h, and the thickness of the Ni coating is 7 μm.

In this embodiment, the pretreatment process for the sintered NdFeB magnet in the step 1̂ includes the following steps:

①-1 vibromilling and chamfering the sintered NdFeB magnet;

①-2 dipping and degreasing the vibromilled and chamfered sintered NdFeB magnet for 10 min in the presence of a dipping and degreasing solution which has a PH of 13 and a temperature of 65° C.;

①-3 pickling the dipped and degreased sintered NdFeB magnet for 300 s by using a nitric acid solution with a volume concentration of 5%;

①-4 ultrasonically cleaning the pickled sintered NdFeB magnet to remove magnetic powder attached to the surface of the product after pickling, wherein an ultrasonic cleaning solution is formed by uniformly mixing sodium citrate and water, and the mass percentage concentration of sodium citrate in the ultrasonic cleaning solution is 5%; and ①-5 rinsing the ultrasonically cleaned sintered NdFeB magnet for three times with overflow water.

Embodiment 3: A composite electroplating method for sintered NdFeB magnet, including: ① a process of pretreating sintered NdFeB magnet, ② a process of electroplating the pre-treated sintered NdFeB magnet, and ③ a process of cleaning and drying the electroplated sintered NdFeB magnet; the process of electroplating the pre-treated sintered NdFeB magnet specifically includes the following steps:

②-1 electro-galvanizing the pre-treated sintered NdFeB magnet to form a Zn coating on the surface of the sintered NdFeB magnet;

②-2 performing first activation treatment on the electro-galvanized sintered NdFeB magnet;

②-3 performing Zn—Ni alloy electroplating treatment on the sintered NdFeB magnet after the first activation treatment to form a Zn—Ni alloy coating on the surface of the Zn coating;

②-4 performing second activation treatment on the sintered NdFeB magnet after the Zn—Ni alloy electroplating treatment;

②-5 performing Cu electroplating treatment on the sintered NdFeB magnet after the second activation treatment to form Cu coating on the surface of the Zn—Ni alloy coating;

②-6 performing Ni electroplating treatment on the sintered NdFeB magnet after the Cu electroplating treatment to form a Ni coating on the surface of the Cu coating.

In this embodiment, the electro-galvanizing process in the step ②-1 uses a zinc sulfate solution as an electroplating solution. The zinc sulfate solution has a PH of 4 and a temperature of 20° C., and the zinc sulfate solution is formed by uniformly mixing zinc sulfate heptahydrate, boric acid, a brightener and water. Every liter of the zinc sulfate solution includes 380 g of zinc sulfate heptahydrate, 20 g of boric acid, and 0.1 ml of the brightener. The electro-galvanizing treatment is carried out for 1 h, and the thickness of the zinc coating is 2 μm.

In this embodiment, the specific process of the first activation treatment in step ②-2 is as follows: the electro-galvanized sintered NdFeB magnet is activated with a first activating solution for 5 s, and the first activating solution is formed by uniformly mixing $HNO_3$, HCl and water. In the first activating solution, the content of $HNO_3$ is 5 ml/L and the content of HCl is 5 ml/L.

In this embodiment, the Zn—Ni alloy electroplating treatment process in step ②-3 uses a Zn—Ni alloy solution as an electroplating solution. The Zn—Ni alloy solution has a temperature of 30° C. and a PH of 5, and the Zn—Ni alloy solution is formed by uniformly mixing potassium chloride, zinc chloride, nickel chloride and water. Every liter of the Zn—Ni alloy solution includes 150 g of potassium chloride, 40 g of zinc chloride, and 80 g of nickel chloride. The Zn—Ni alloy electroplating treatment is carried out for 1 h, and the thickness of the Zn—Ni alloy coating is 1.5 μm.

In this embodiment, the specific process of the second activation treatment in step ②-4 is as follows: the sintered NdFeB magnet after the Zn—Ni alloy electroplating treatment is activated with a second activating solution for 10 s, and the second activating solution is formed by uniformly mixing citric acid and water. The content of citric acid in the second activating solution is 0.2 g/L.

In this embodiment, the Cu electroplating treatment process in step ②-5 uses a Cu solution as an electroplating solution. The Cu solution has a temperature of 45° C. and a PH of 9, and the Cu solution is formed by uniformly mixing copper pyrophosphate, potassium pyrophosphate, and water. Every liter of the Cu solution includes 30 g of copper pyrophosphate and 240 g of potassium pyrophosphate. The Cu electroplating treatment is carried out for 2 h, and the thickness of the Cu coating is 3 μm.

In this embodiment, the Ni electroplating treatment process in step ②-6 uses a Ni solution as an electroplating solution. The Ni solution has a temperature of 45° C. and a PH of 4, and the Ni solution is formed by uniformly mixing nickel sulfate, nickel chloride, and water. Every liter of the Ni solution includes 250 g of nickel sulfate and 30 g of nickel chloride. The Ni electroplating treatment is carried out for 2 h, and the thickness of the Ni coating is 3 μm.

In this embodiment, the pretreatment process for the sintered NdFeB magnet in the step ① includes the following steps:

①-1 vibromilling and chamfering the sintered NdFeB magnet;

①-2 dipping and degreasing the vibromilled and chamfered sintered NdFeB for 2 min in the presence of a dipping and degreasing solution which has a PH of 9 and a temperature of 50° C.;

①-3 pickling the dipped and degreased sintered NdFeB magnet for 15 s by using a nitric acid solution with a volume concentration of 2%;

①-4 ultrasonically cleaning the pickled sintered NdFeB magnet to remove magnetic powder attached to the surface of the product after pickling, wherein an ultrasonic cleaning solution is formed by uniformly mixing sodium citrate and water, and the mass percentage concentration of sodium citrate in the ultrasonic cleaning solution is 5%;

①-5 rinsing the ultrasonically cleaned sintered NdFeB magnet for three times with overflow water.

What is claimed is:

1. A composite electroplating method for sintered NdFeB magnet, comprising: ① a process of pre-treating a sintered NdFeB magnet, ② a process of electroplating the pre-treated sintered NdFeB magnet, and ③ a process of cleaning and drying the electroplated sintered NdFeB magnet, wherein the process of electroplating the pre-treated sintered NdFeB magnet comprises the following steps:

②-1 performing an electro-galvanizing treatment on the pre-treated sintered NdFeB magnet to form a Zn coating on the surface of the sintered NdFeB magnet;

②-2 performing a first activation treatment on the electro-galvanized sintered NdFeB magnet;

②-3 performing a Zn—Ni alloy electroplating treatment on the sintered NdFeB magnet after the first activation treatment to form a Zn—Ni alloy coating on the surface of the Zn coating;

②-4 performing a second activation treatment on the sintered NdFeB magnet after the Zn—Ni alloy electroplating treatment;

②-5 performing a Cu electroplating treatment on the sintered NdFeB magnet after the second activation treatment to form a Cu coating on the surface of the Zn—Ni alloy coating; and ②-6 performing a Ni electroplating treatment on the sintered NdFeB magnet after the Cu electroplating treatment to form a Ni coating on the surface of the Cu coating, wherein the process of the Zn—Ni alloy electroplating treatment in step ②-3 uses a Zn—Ni allo solution as an electroplating solution; the Zn—Ni alloy solution has a temperature of 30-35° C. and a pH of 5-5.5, and the Zn—Ni alloy solution is formed by uniformly mixing potassium chloride, zinc chloride, nickel chloride and water; every liter of the Zn—Ni alloy solution comprises 150-200 g of potassium chloride, 40-70 g of zinc chloride, and 80-120 g of nickel chloride; the Zn—Ni alloy electroplating treatment is carried out for 1-2.5 h; and the thickness of the Zn—Ni alloy coating is 1.5-4 μm.

2. The composite electroplating method for a sintered NdFeB magnet according to claim 1, wherein the process of the electro-galvanizing treatment in the step ②-1 uses a zinc sulfate solution as an electroplating solution, the zinc sulfate solution has a PH of 4-5 and a temperature of 20-40° C., and the zinc sulfate solution is formed by uniformly mixing zinc sulfate heptahydrate, boric acid, a brightener and water; every liter of the zinc sulfate solution comprises 380-400 g of zinc sulfate heptahydrate, 20 g-40 g of boric acid, and 0.1-0.2 ml of the brightener; the electro-galvanizing treatment is carried out for 1-2 h; and the thickness of the zinc coating is 2-4 μm.

3. The composite electroplating method for sintered NdFeB magnet according to claim 1, wherein the process of the first activation treatment in step ②-2 is as follows: the electro-galvanized sintered NdFeB magnet is activated with a first activating solution for 5-15 s, the first activating solution is formed by uniformly mixing $HNO_3$, HCl and water, and in the first activating solution, the content of $HNO_3$ is 5 ml/L and the content of HCl is 5 ml/L.

4. The composite electroplating method for sintered NdFeB magnet according to claim 1, wherein the process of the second activation treatment in step ②-4 is as follows: the sintered NdFeB magnet after the Zn—Ni alloy electroplating treatment is activated with a second activating solution for 10-20 s, the second activating solution is formed by uniformly mixing citric acid and water, and the content of citric acid in the second activating solution is 0.2-0.5 g/L.

5. The composite electroplating method for a sintered NdFeB magnet according to claim 1, wherein the process of the Cu electroplating treatment in step ②-5 uses a Cu solution as an electroplating solution; the Cu solution has a temperature of 45° C. and a PH of 9-12, and the Cu solution is formed by uniformly mixing copper pyrophosphate, potassium pyrophosphate, and water; every liter of the Cu solution comprises 30-70 g of copper pyrophosphate and 240-400 g of potassium pyrophosphate; the Cu electroplating treatment is carried out for 2-4 h; and the thickness of the Cu coating is 3-5 μm.

6. The composite electroplating method for sintered NdFeB magnet according to claim 1, wherein the process of the Ni electroplating treatment in step ②-6 uses a Ni solution as an electroplating solution; the Ni solution has a temperature of 45° C. and a PH of 4, and the Ni solution is formed by uniformly mixing nickel sulfate, nickel chloride, and water; every liter of the Ni solution comprises 250-350 g of nickel sulfate and 30-70 g of nickel chloride; the Ni electroplating treatment is carried out for 2-4 h; and the thickness of the Ni coating is 3-7 μm.

7. The composite electroplating method for sintered NdFeB magnet according to claim 1, wherein the process of pre-treating the sintered NdFeB magnet in the step ① comprises the following steps:

①-1 vibromilling and chamfering the sintered NdFeB magnet;

①-2 dipping and degreasing the vibromilled and chamfered sintered NdFeB magnet for 2-10 min in the presence of a dipping and degreasing solution which has a PH of 9-13 and a temperature of 50-65° C.;

①-3 pickling the dipped and degreased sintered NdFeB magnet for 15-300 s by using a nitric acid solution with a volume concentration of 2-5%;

①-4 ultrasonically cleaning the pickled sintered NdFeB magnet to remove magnetic powder attached to the surface of the-pickled sintered NdFeB magnet, wherein an ultrasonic cleaning solution is formed by uniformly mixing sodium citrate and water, and the mass percentage concentration of sodium citrate in the ultrasonic cleaning solution is 5%; and ①-5 rinsing the ultrasonically cleaned sintered NdFeB magnet for three times with overflow water.

* * * * *